US005381810A

United States Patent [19]

Mosher

[11] Patent Number: 5,381,810

[45] Date of Patent: Jan. 17, 1995

[54] ELECTRONICALLY CONTROLLED CARBON-CLEANING SYSTEM FOR INTERNAL COMBUSTION ENGINES

[76] Inventor: Frederick A. Mosher, 3449 Summerset Cir., Costa Mesa, Calif. 92626

[21] Appl. No.: 965,151

[22] Filed: Oct. 22, 1992

[51] Int. Cl.[6] ..... B08B 9/02

[52] U.S. Cl. ..... 134/56 R; 134/111; 134/169 A; 123/198 A; 141/21

[58] Field of Search ..... 134/200, 169 C, 167 C, 134/168 C, 166 R, 167 R, 169 A, 56 R, 57 R, 58 R, 111; 123/198 A; 141/2, 18, 21, 22, 198; 417/36, 41, 45, 40

[56] References Cited

U.S. PATENT DOCUMENTS

| | | | |
|---|---|---|---|
| 1,083,315 | 1/1914 | Yetman | 417/41 |
| 1,287,062 | 12/1918 | McLarty | 417/41 |
| 1,780,605 | 11/1930 | Spinney | 141/21 |
| 1,820,552 | 8/1931 | Wooley | 134/111 X |
| 2,784,747 | 3/1957 | Weempe | 141/21 |
| 2,912,990 | 11/1959 | Wilson | 134/169 A |
| 3,049,131 | 6/1963 | Williams | 134/169 A |
| 3,531,323 | 9/1970 | Carpenter et al. | 134/169 R |
| 3,671,142 | 6/1972 | Calabrese | 417/36 |
| 4,086,930 | 5/1978 | Hiss | 134/169 A |
| 4,095,920 | 6/1978 | Needham et al. | 417/36 |
| 4,166,713 | 9/1979 | Debrey | 417/36 |
| 4,265,262 | 5/1981 | Hotine | 417/36 |
| 4,877,043 | 10/1989 | Carmichael et al. | 134/169 A |
| 4,991,608 | 2/1991 | Schweiger | 134/169 A |
| 5,090,433 | 2/1992 | Kamaga | 134/169 C |
| 5,147,610 | 9/1992 | Watanabe et al. | 134/166 R |

FOREIGN PATENT DOCUMENTS

| | | | |
|---|---|---|---|
| 53-76402 | 7/1978 | Japan | 417/36 |
| 410278 | 5/1934 | United Kingdom | 417/36 |
| 860854 | 2/1961 | United Kingdom | 141/21 |

*Primary Examiner*—Frankie L. Stinson

[57] ABSTRACT

An electronically controlled carbon-cleaning apparatus for removal of carbon deposits in internal combustion engines. A microcomputer and associated electronics perform all control, and user interface functions. Firmware provides self test, automatic voltage adjustment to direct current systems used on internal combustion engines. The apparatus includes a fill feature whereby a solution tank is filled automatically. The apparatus circulates a fuel-cleaner solution through the fuel injection system of the engine while it is operated, thereby saving the time and cost associated with the removal and hand cleaning of injectors. Fuel-cleaner solution level and run time are continuously monitored by the microcomputer and displayed on a LCD display. Solution pressure is continuously monitored and necessary adjustments automatically made while circulating fuel-cleaner solution. An engine cut-off solenoid driver is provided to shut down the engine in the event of a empty solution tank. An audio alarm comprised of two unique sets of frequencies alerts the operator when necessary.

15 Claims, 4 Drawing Sheets

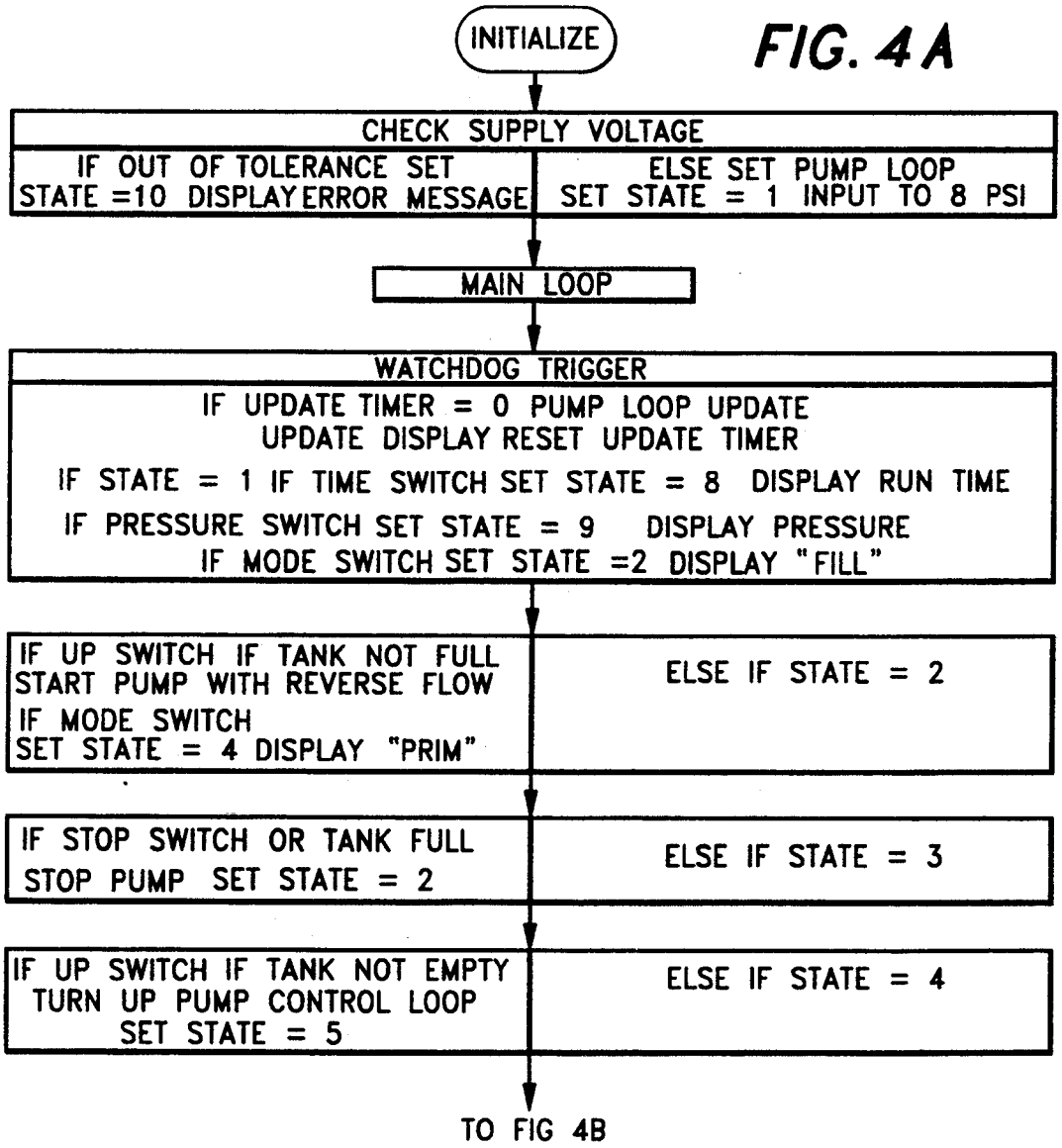
THE MAX 4500 FIRMWARE IS IMPLEMENTED AS A STATE MACHINE.
| | | |
|---|---|---|
| THE STATES ARE: | STATE 0– | INITIALIZATION/DIAGNOSTIC STATE |
| | STATE 1– | READY MODE |
| | STATE 2– | FILL MODE, PUMP OFF |
| | STATE 3– | FILL MODE, PUMP ON |
| | STATE 4– | PRIME MODE, PUMP OFF |
| | STATE 5– | PRIME MODE, PUMP OFF |
| | STATE 6– | RUN MODE |
| | STATE 7– | STOP MODE |
| | STATE 8– | TIME SET MODE |
| | STATE 9– | PRESSURE SET MODE |
| | STATE 10– | ERROR STATE |

ELECTRONICALLY CONTROLLED CARBON-CLEANING SYSTEM FOR INTERNAL COMBUSTION ENGINES

BACKGROUND

1. Field of Invention

This apparatus relates to a method of automatically controlling machines that supply solvents to and into internal combustion engines for the purpose of cleaning internal parts in those internal combustion engines.

2. Description of Prior Art

A problem common to internal combustion engines is the build-up of carbon and other organic compounds on the internal engine surfaces. If ignored this build-up of material causes parts to change in both shape and size. This change is considered more detrimental today because in addition to a loss of efficiency, air pollution is drastically increased. If left undeterred small orifices are closed off and eventually the engine ceases to operate.

This problem is particularly damaging to all types of fuel injectors. Today with increased awareness of air pollution caused by the inefficient burning of petroleum products it is important to keep injectors and their associated parts clean.

An early solution to this problem was to dismantle the engine and physically scrape or sandblast the deposits off the parts. Dismantling an engine and a fuel delivery system requires a relatively long down time and is very skilled-labor intensive. As a result it is a very expensive choice and, therefore not performed very often.

In order to reduce the time and money required to maintain the integrity of these components solvents were developed that would remove some of the deposits and make the remaining removal processes less labor intensive. U.S. Pat. Nos. 4,082,565 Sjólander (1978) and 4,804,005 Hartopp (1989) describes an apparatus used to chemically clean injectors which have been removed from an engine.

An improvement was the development of solvents which could be added to the engine fuel storage tank and allow the solvent to run through the engine with the fuel while the engine operated. This introduced a new problem because in many cases the solvents did not dissolve the deposits but rather released them. Some of the dislodged particles returned to the fuel tank, others moved to different parts of the engine. When free, these deposit particles could do more damage than when they were fixed on the engine parts.

A solution to this new problem was to feed the engine from a separate fuel and cleaning solvent mixing tank and discard any remaining fuel-cleaner mixture along with the released particles.

In order to overcome the problem of not completely dissolving the carbon and organic deposits new stronger solvents were formulated. These could be mixed with limited quantities of fuel in a mixing tank and circulated through the fuel system of the engine while it was operated.

Unfortunately these new superior cleaners are so corrosive that they cannot be added to the vehicles fuel storage tank because they will dissolve rubber and plastic hoses and damage some metal parts. This is a second substantial reason for using a separate fuel-solvent mixing tank.

The prior art improves this apparatus by adding pressure control devices, controls for operating the injectors, and a timing device that should allow the cleaning cycle to go on without the presence of the mechanic. Finally the whole apparatus is made portable by placing it on a wheeled dolly. This allows the described apparatus to be moved to the vehicle.

An apparatus embodying these features is described by U.S. Pat. Nos. 4,520,773 Koslow (1985), 4,606,311 Reyes et al (1986), 4,877,043 Carmichael (1989),. The apparatus described in these above mentioned patents require that the operator be specifically trained to operate the equipment. There are toggle switches and gauges which must be set. Previously described apparatus require the operator monitor the pressures throughout the service to insure proper operation.

Previously described apparatus require the pump motor to operate at full capacity. Pressure control is accomplished by bypassing excessive flow and pressure back to the mixture tank. This causes the pump motor to become excessively heated. In addition the fuel-cleaner mixture is also heated by the operating engine which adds more heat to the pump motor.

Previously described apparatus require a series of switches and relays to operate the solenoid valves and pump motor. These components are prone to failure due to their electro-mechanical nature.

Another limitation to the previously described apparatus is that the user must make many hand adjustments to set up the apparatus and through out the cleaning cycle.

Another limitation of the previously described apparatus is fuel-cleaner mixture supply pressures are controlled by setting various mechanical devices. The resultant pressure is prone to variation from dirt particles, changes in temperature or the addition of cleaning solvent to the fuel. Changes in engine speed or rate of fuel consumption as the injectors open up also change fuel pressure. In using the described apparatus the operator should make a hand adjustment of fuel pressure controls repeatedly as each of these changes occur.

Prior art does not consider the ramifications of a possible leak of the hot fuel-cleaner mixture occurring internal to the apparatus. The hot fuel would begin to vaporize since it was no longer under pressurization. This would create an explosive environment. The closing or opening of an electro-mechanical switch could cause a spark which would ignite the vapors.

A continuous uninterrupted source of fuel is essential for the operation of diesel engines. If a diesel engine is allowed to run out of fuel air will enter the fuel lines and thus the fuel injection system. It is a time consuming inconvenience to re-prime the fuel injection system and remove all the air from the injection system in order to get the engine started again. The prior art does not describe a safeguard to prevent the diesel engine from running out of fuel.

The previously described apparatus employ mechanical gauges and pressure regulators, relays, solenoid valves and switches. U.S. Pat. No. 4,787,348 Taylor (1988) describes an apparatus that uses pressure sensing probes sending electrical signals to relays and the relays control solenoid valves which effect the required changes in the system. Unfortunately, the described apparatus are exceedingly complicated. Taylor's diagram, sheet 3 of his application, shows two 3 way solenoid valves, three relays, six electro-mechanical switches, many components and about 60 electrical connections.

In use, the previously described apparatus is wheeled outside on a dolly to attach to a vehicle. The combination of mechanical jarring, sub-zero weather conditions and dampness leads to frequent mechanical failure of one or more components. When the described apparatus fails, it may stop operating, but it may also leave a fuel line open to an operating engine which can lead to destruction of the engine or a serious fire hazard.

When the previously described apparatus is attached to an engine there is no way to know if it is operating properly. The user is left to hook it up and only when it fails is he alerted to the fact that he has a malfunction.

Another limitation of the Taylor apparatus is that there is no means for adjusting the pressure of the fuel-cleaner mixture that is fed to the diesel engine. This is a real problem in the field since diesel engines require pressures of 1 to 12 PSI. If the pressure is exceeded the inlet seals of the injector pump on the engine will begin to leak.

Another limitation of the previously described apparatus is that they only operate at one voltage with the exception of the Taylor apparatus which also operates on 115 volts of alternating current. In practice alternating current is not available where these engines are located. Engines have electrical systems which operate at many different voltages and it is convenient to be able to operate the apparatus by drawing power from the engines electrical system, no matter what the operating voltage. More serious, if for some reason the supplied voltage is out of the operating range of the described apparatus and the user attaches it anyway, the described apparatus could be destroyed or seriously damaged.

OBJECTS AND ADVANTAGES

The object of the electronically controlled carbon-cleaning system for internal combustion engines to provide a more reliable method of controlling the apparatus in use. This is accomplished by use of electronic switching circuits controlled by a microprocessor and program or firmware. Mechanical switches, relays and solenoids and their attendant mechanical problems are entirely eliminated and all controls are by solid state devices.

The first improvement is that this apparatus automatically performs self tests and alerts the user via a warning read-out if there is a malfunction. The user need not attach it to an engine and have it fail to find out if it is functioning.

Another improvement is to describe an apparatus that requires less operator set-up and less operator hand adjustment than previously described apparatus. This is accomplished by electronic sensing devices that send voltages to the computer and the firmware which makes adjustments automatically. One such adjustment is to control the electric motor velocity and thus the pump speed which adjusts the fuel-cleaner solution pressure in response to changes from a pre-set target pressure. The result is a self monitoring self adjusting apparatus that does not need constant monitoring and adjustment by the user. It adjusts itself for changes occasioned by dirt particles, changes in density due to the addition of cleaning solvent, changes in density occasioned by changes in temperature, changes in fuel-cleaner solution consumptions as engine speed changes or as fuel injectors become unclogged.

Another object is to offer an apparatus that operates at any supplied voltage and one where the adjustment for voltage is made automatically via firmware and the microcomputer in the described apparatus. The described apparatus also provides a read-out warning to the operator and automatically shuts off if the supplied voltage is out of the range of voltages it can accommodate. This is an improvement over previously described apparatus that only operate on one voltage and are destroyed by attaching them to an incorrect voltage supply.

Another object is to provide an apparatus which checks and verifies that all procedures and measurements are correct and sufficient prior to allowing the operator to progress to the next step. The firmware in the described apparatus verifies that there is enough fuel-cleaner solution to perform the cleaning procedure. It also verifies that the pressure is correct and stable prior to allowing the engine to be started.

Another object is to provide an apparatus which prompts the operator for the next step. After the firmware has verified that all of the necessary preconditions for a given task have been met it alerts the operator and waits for the operator to select the next task.

A further object is to reduce the operating temperature of the motor and pump components. The physical separation of the motor from the pump insures that heat introduced to the pump by the heated cleaning solution returning from the serviced engine does not add heat to the motor. By the same reasoning heat generated by the motor is not transferred to the pump.

Another object is to reduce assembly time, a further object is to reduce material cost and still another object is to reduce the weight of the apparatus. This has all been accomplished by elimination of all relays and solenoid valves.

Another object of this invention is to avoid excessive spilling of the cleaning solution when changing the filter. This is accomplished by locating the filter canister above the solution tank.

DESCRIPTION OF DRAWINGS

FIGS. 4A and 4B show a detailed presentation of the program flow in coded form.

DESCRIPTION—FIGS. 1, 2

Figure 1:
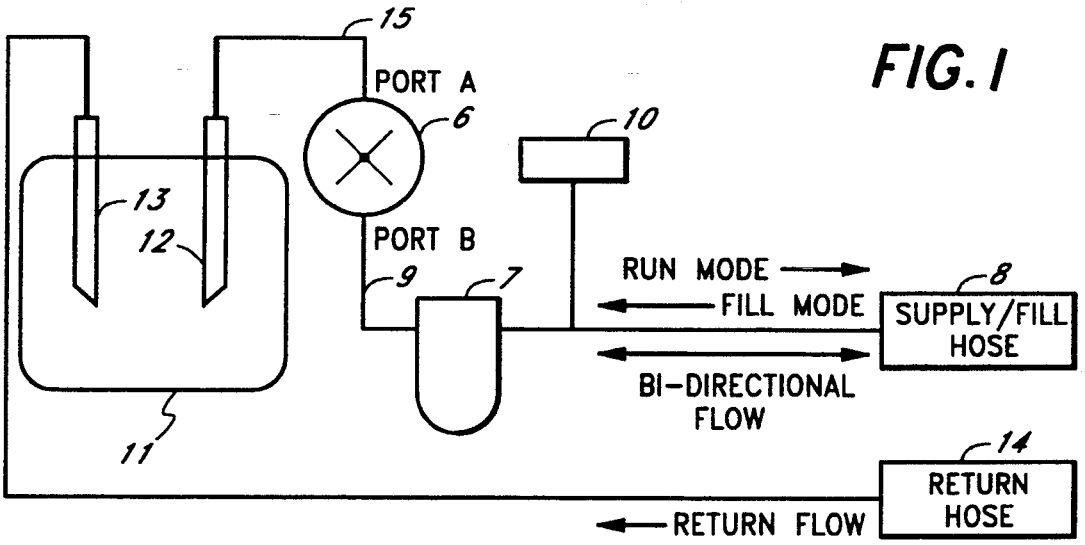
FIG. 1 shows the fluid flow for the fuel-cleaner solution.
Figure 2:
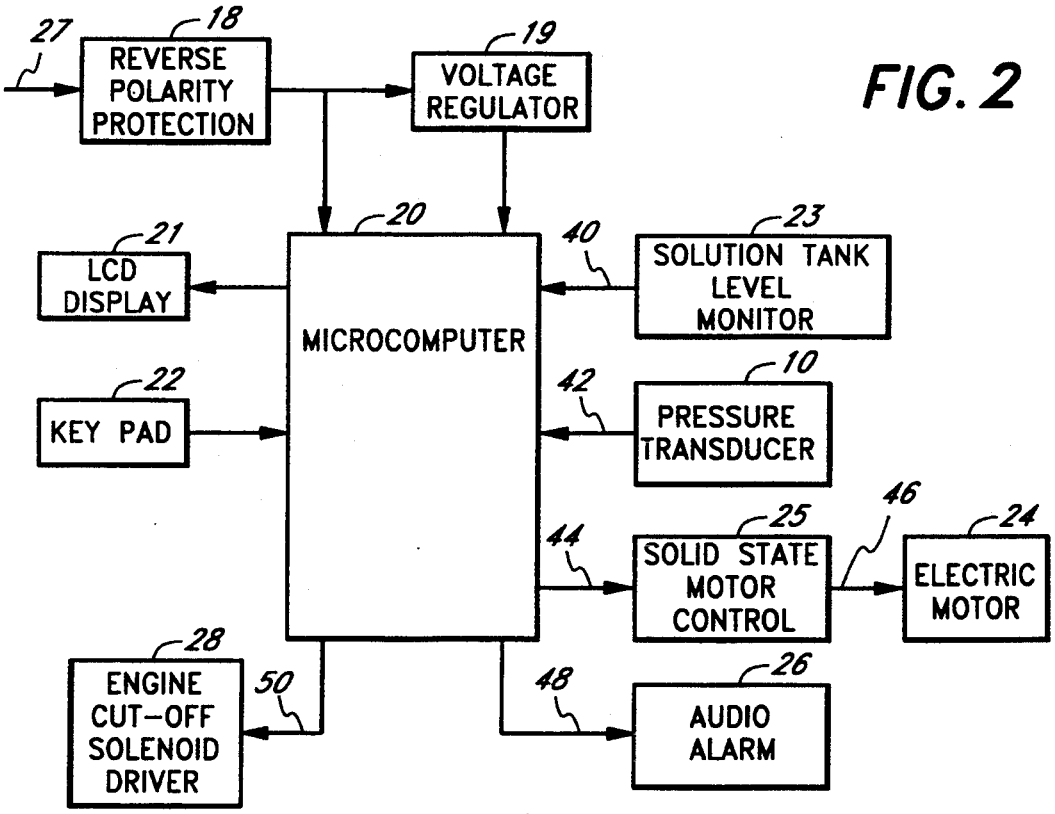
FIG. 2 shows the electronic block diagram of the microcomputer control system.

The electronically controlled carbon-cleaning system for internal combustion engines comprises a microcomputer 20 in FIG. 2 and all of the associated control peripheral electronics shown in FIG. 2, an electric motor 24 in FIG. 2 and a pump 6 in FIG. 1. The microcomputer and associated control peripheral electronics are assembled onto a conventional printed wiring board (not shown) and mounted to the substantial structure or surface of the apparatus. A motor voltage 46 wire connects to electric motor 24.

Figure 3:
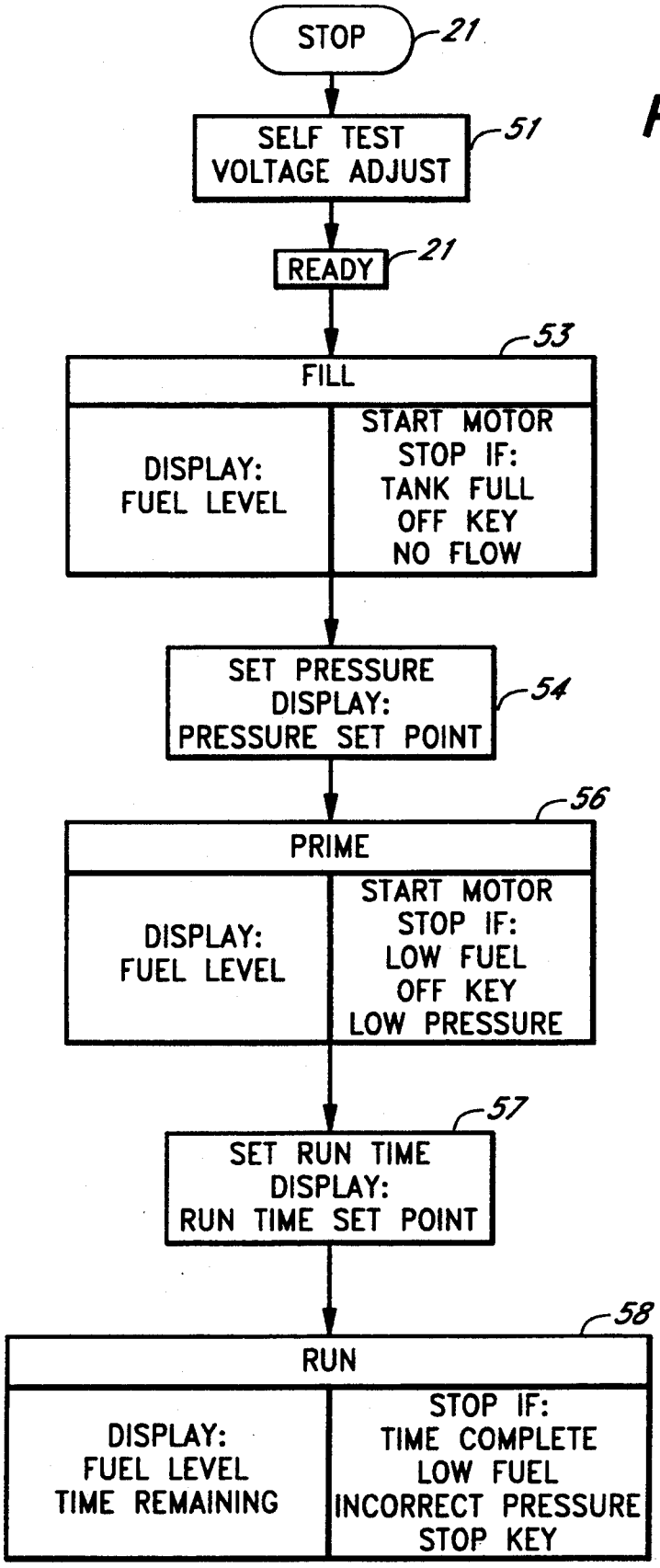
FIG. 3 shows the functional program flow chart of the firmware.
Figure 4B:
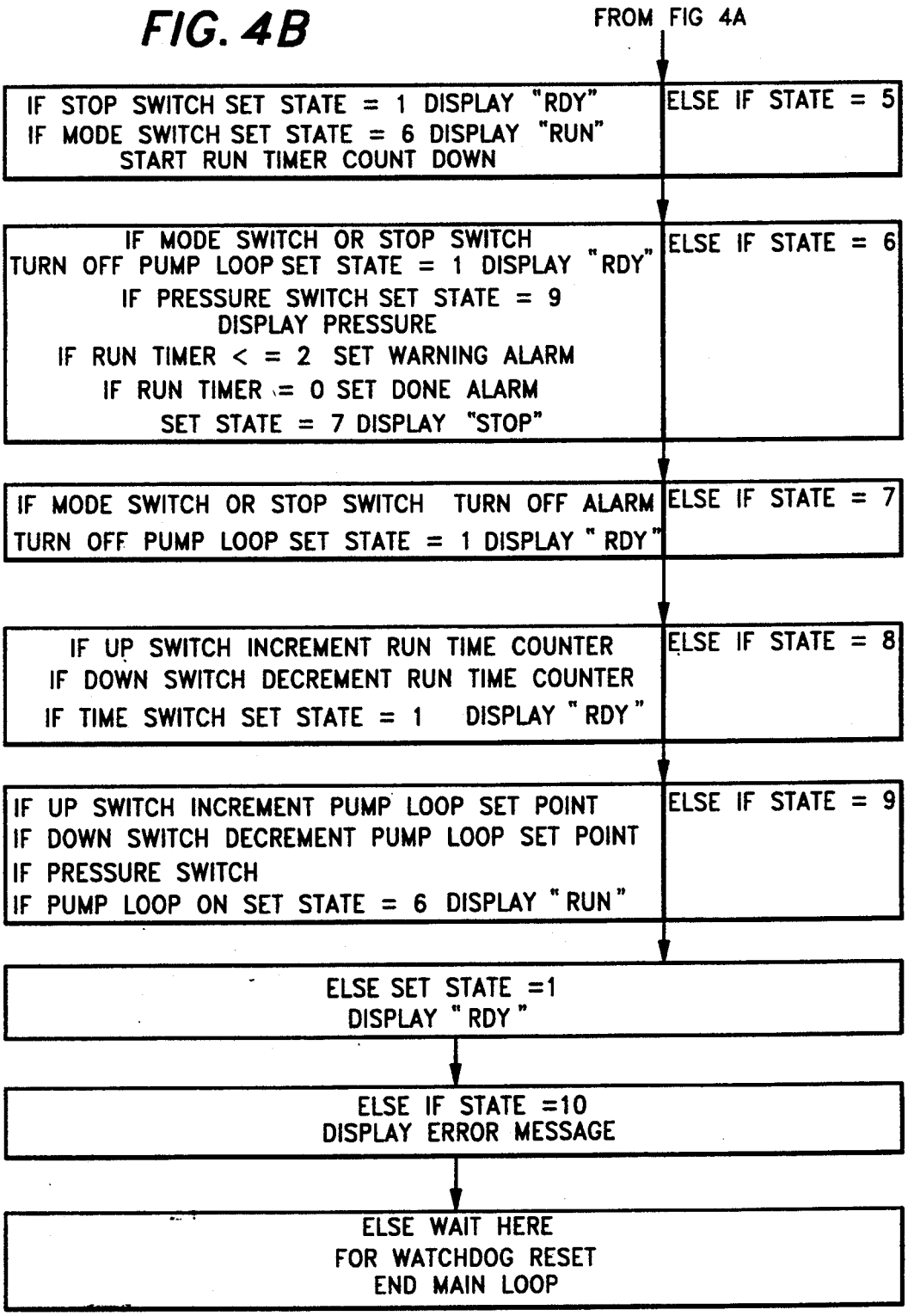

ELECTRO-MECHANICAL OPERATION—FIGS. 1 to 3

Motor/Pump Assembly

The motor/pump assembly is comprised of a separate electric motor 24 in FIG. 2 and a bi-directional pump 6 in FIG. 1. A velocity reduction mechanism is used to couple the rotational energy from electric motor 24 to pump 6.

ELECTRONICS AND PROGRAM OPERATION

Program instructions arranged in modules or modes 51, 53, 54, 56, 57 and 58 shown in FIG. 3 via microcomputer 20 in FIG. 2 controls all operations of the apparatus. As stored program instructions are executed by microcomputer 20 the various peripheral devices perform their required task. Upon application of power by connecting input power cable 27 the polarity is checked by reverse polarity protection 18. Microcomputer 20 receives regulated voltage from voltage regulator 19 and also monitors the raw voltage. Microcomputer 20 sends the information as to the current mode of the program, status of the apparatus, remaining run time 58 in FIG. 3, and solution tank 11 FIG. 1 level to LCD display 21 in FIG. 1. Keypad 22 provides the operator interface to microcomputer 20. Solution tank level monitor 23 measures the fuel-cleaner solution level in solution tank 11 in FIG. 1, translates the physical level to a voltage and passes this voltage to microcomputer 20 in FIG. 2 via tank level monitor signal wires 40. Pressure transducer 10 in FIGS. 1 and 2, translates the pressure in supply/fill hose 8 in FIG. 1 to a voltage and transfers the voltage via pressure signal wires 42 in FIG. 2 to microcomputer 20 Programmed instructions 54 in FIG. 3 via microcomputer 20 in FIG. 2 stores the voltage in digital form for later use in making calculations or processing. Program instructions via microcomputer 20 by using motor control signal wires 44 and solid state motor control 25 control the direction and velocity of electric motor 24 thereby controlling pump 6 in FIG. 1. Audio alarm 26 in FIG. 2 emits the alarm tones created by program instructions and sent by microcomputer 20 via alarm control signal wires 48. Engine cut-off solenoid driver 28 is controlled by program instructions and sent commands via microcomputer 20 via cut-off driver control signal wires 50. Cut-off solenoid driver 28 is used to control conventional fuel cut-off solenoid (not shown) of the work piece engine being cleaned.

FILL MODE

Supply/fill hose 8 in FIG. 1 in this process becomes a siphon line. Supply/fill hose 8 is inserted into an adjacent tank containing fuel. Program instructions 53 in FIG. 3 instructs microcomputer 20 in FIG. 2 to send a fill control voltage to solid state motor control 25 via motor control signal wires 44. Electric motor 24 rotates in the fill mode direction and causes pump 6 in FIG. 1 to rotate in the direction which causes a vacuum to be generated on filter 7 side of pump 6. Filter/pump interconnecting hose 9 conducts the vacuum to filter 7 and the vacuum is applied to supply/fill hose 8. Fuel begins to flow from the adjacent conventional tank (not shown) into supply/fill hose 8, through filter 7 and into pump 6 via filter pump interconnecting hose 9. The fuel is then pushed by pump 6 into transfer hose 15 and down pick up tube 12 into solution tank 11. This process continues until program instructions 53 in FIG. 3 finds via microcomputer 20 in FIG. 2 via solution tank level monitor 23 that solution tank 11 level is full. Solution tank level monitor 23 communicates to microcomputer 20 via tank level monitor signal wires 40. Program instructions 53 in FIG. 3 responds via microcomputer 20 in FIG. 2 by removing the voltage from, via motor control signal wires 44, solid state motor control 25. Solid state motor control 25 thus removes power from electric motor 24 via motor voltage wires 46. Pump 6 in FIG. 1 thus stops.

PRIME MODE

Program 58 in FIG. 3 instructs microcomputer 20 in FIG. 2 to send a voltage via motor signal wires 44 to solid state motor control 25. Solid state motor control 25 applies forward polarity voltage via motor voltage wires 46 to electric motor 24 causing pump 6 in FIG. 1 to start. Fuel-cleaner solution is drawn up feed tube 12 from solution tank 11 by the vacuum in transfer hose 15 created by pump 6 in FIG. 1. Pump 6 pushed the fuel-cleaner solution via fuel/pump interconnecting hose 9 to filter 7. As it leaves filter 7 the fuel-cleaner solution pressurizes pressure transducer 10 and flows through supply/fill hose 8 to the engine being cleaned. Return hose 14 is connected to work piece engine fuel injection system return port and carries the returned unused fuel-cleaner solution to solution tank 11 via inlet tube 13. Stored program instructions cause microcomputer 20 in FIG. 2 to send a voltage via cut-off driver control signal wires 50 to engine cut-off solenoid driver 28 to be turned on. This allows the work piece engine to be started.

RUN MODE—CLOSED LOOP OPERATION

Run mode is comprised of prime mode operation with the addition of the following processes. The program is in control of the apparatus via microcomputer 20 in FIG. 2 just as it is in prime mode. Microcomputer 20 executes stored program instructions of prime mode and adjust electric motor 24 accordingly. Run mode stored program instructions 58 in FIG. 3 contains the algorithm for the closed-loop servo control system. The operator has entered the desired system pressure through keypad 22 in FIG. 2 via stored program instructions 54 in FIG. 3. Microcomputer 20 in FIG. 2 has stored the data as the pressure set-point. Microcomputer 20 via pressure transducer 10 monitors the system pressure. Microcomputer 20 via its program instructions continuously compares the measured system pressure by pressure transducer 10 to the set pressure, interprets the data, makes calculations and adjusts the voltage carried by motor control signal wires 44 to solid state motor control 25, which controls motor voltage 46 to electric motor 24 and thus changes the velocity of pump 6 in FIG. 1. As the velocity of pump 6 varies, the operating pressure of the fuel-cleaner solution is adjusted. This procedure continues while the apparatus is in the run mode. While in the run mode program instructions 58 in FIG. 3 monitors run time timer 58, solution tank level monitor 23 in FIG. 2, and pressure transducer 10 in FIGS. 1 and 2. Program instructions also cause microcomputer 20 to maintain the on status of engine cut-off solenoid driver 28. Engine cut-off solenoid driver 28 will remain on until programmed instructions 58 in FIG. 3 receive a signal via microcomputer 20 in FIG. 2 that an out of time message from run time timer 57 in FIG. 3 has occurred or, a stop message from keypad 22 in FIG. 2 has occurred or, a solution tank 11 in FIG. 1 empty signal is received from solution tank level monitor 23 or a low pressure signal is received from pressure transducer 10. At the time any one of the above or more than one occur programmed instructions 58 in FIG. 3 will cause microcomputer 20 in FIG. 2 via cut-off driver signal wires 50 to turn off engine solenoid driver 28. Audio alarm 26 is controlled by microcomputer 20 via firmware in the following manner.

Audio alarm 26 in FIG. 2 will activated with a unique first set of frequencies when solution tank 11 in FIG. 1 as indicated by solution tank level monitor 23 in FIG. 2 indicates to program instructions 58 in FIG. 3 that the reserve level has been reached, or run time timer 57 reaches the 2 minutes remaining point.

Audio alarm 26 will in FIG. 2 activated with a unique second set of frequencies when solution tank 11 in FIG. 1 as indicated by solution tank level monitor 23 in FIG. 2 indicates to program instructions 58 in FIG. 3 that the empty level has been reached, or run time timer 57 reaches the zero minutes remaining point.

USER OPERATION OF APPARATUS—FIGS. 1 to 3

The user moves the apparatus to a remote source of fuel or a conventional fuel tank (not shown). The operator inserts supply/fill hose 8 in FIG. 1 into a conventional fuel tank (not shown). The operator then adds the appropriate amount of concentrated cleaner to mixture tank 11.

The user next connects the apparatus to a direct current voltage source via input power cable 27 in FIG. 2. The apparatus automatically powers up and begins self test and voltage adjust 51 in FIG. 3. Microcomputer 20 in FIG. 2 verifies that the voltage is within an acceptable range, and that all internal electronics are functioning correctly. Voltage regulator 19 provides a regulated voltage to microcomputer 20 and Liquid Crystal Display 21, hereinafter referred to as "LCD display". Microcomputer 20 then performs a calculation to determine the proper pulse width to apply to electric motor 24.

Upon completion of self test 51 in FIG. 3 LCD display 21 in FIG. 2 indicates or displays RDY. The operator follows the instructions to progress to fill 53 in FIG. 3 mode by depressing mode key on keypad 22 in FIG. 2. LCD display 21 indicates FILL 53 in FIG. 3 to confirm that microcomputer 20 in FIG. 2 has accepted the commands.

The operator presses up arrow key on keypad 22. Microcomputer 20 starts electric motor 24 thus starting pump 6 in FIG. 1, in the reverse direction, and solution tank 11 begins to fill from remote source of fuel. When solution tank 11 becomes full microcomputer 20 in FIG. 2 automatically shuts off electric motor 24 causing pump 6 in FIG. 1 to stop. If the operator wishes to stop the filling process prior to solution tank 11 becoming full he or she presses down arrow key on keypad 22 in FIG. 2 and microcomputer 20 will terminate the filling process by stopping electric motor 24 which causes pump 6 in FIG. 1 to stop.

The operator presses mode key on keypad 22 in FIG. 2 to progress to set pressure 54 in FIG. 3 mode. The default pressure is displayed on LCD display 21 in FIG. 2. LCD display 21 displays P=05. The operator adjusts set-point pressure 54 in FIG. 3 by using up and down arrow keys on keypad 22 in FIG. 2. As the operator presses up or down arrow keys on keypad 22 microcomputer 20 corresponding increments or decrements pressure setting displayed by LCD display 21. When pressure setting is satisfactory the operator depresses mode key on keypad 22 and advances to prime mode 56 in FIG. 3. PRIM is displayed on LCD display 21 in FIG. 2. The operator now removes supply/fill hose 8 in FIG. 1 from remote source of fuel.

The operator connects supply/fill hose 8 and return hose 14 together. The operator presses up arrow key on keypad 22 in FIG. 2. Microcomputer 20 starts electric motor 24 which causes pump 6 in FIG. 1 to start. This causes concentrated cleaner and fuel to be mixed creating a fuel-cleaner solution. Additionally all air will be purged from supply/fill hose 8 and return hose 14 by pump 6 circulating fuel-cleaner solution. This process takes about 3 minutes and microcomputer 20 in FIG. 2 notifies the operator that this operation is complete by briefly sounding audio alarm 26. The operator depresses down key on keypad 22 to stop electric motor 24 which stops pump 6 in FIG. 1.

The operator disconnects supply/fill hose 8 in FIG. 1 and return hose 14. The operator next connects supply/fill hose 8 from the apparatus to an inlet port of the fuel injector pump of the work piece engine (not shown) to be cleaned. The operator connects return hose 14 of the apparatus to an outlet of the fuel rail or return side of the fuel injection system of the work piece engine.

The operator connects engine cutoff solenoid driver 28 in FIG. 2 to the work piece engine cutoff solenoid.

The operator depresses up arrow key on keypad 22. Microcomputer 20 starts electric motor 24 and pump 6 in FIG. 1 starts. Trapped air will be purged from supply/fill hose 8 at this time. Microcomputer 20 in FIG. 2 will sound audio alarm 26 when all air has been removed.

The operator depresses mode key on keypad 22 in FIG. 2 to cause microcomputer 20 to advance to set run time 57 in FIG. 3 mode. LCD display 21 in FIG. 2 displays T=45. The operator uses up and down arrow keys on keypad 22 to adjust run time 57 in FIG. 3 if required. Microcomputer increments or decrements LCD display 21 in FIG. 2 as the operator adjusts run time 57 in FIG. 3. upon completion the operator depresses mode key on keypad 21 FIG. 2 again and microcomputer 20 advances to run mode 58 in FIG. 3. LCD display 22 in FIG. 2 will indicate RUN. The operator now starts work piece engine. The operator may leave the apparatus unattended while it circulates cleaning solution through injection system of work piece engine and monitors fuel-cleaner solution pressure.

Program 58 in FIG. 3 monitors run time 57 in FIG. 3 and when microcomputer 20 in FIG. 2 counts down run time 57 in FIG. 3 to the point that there is 2 minutes of run time 57 remaining or microcomputer 20 in FIG. 2 is informed via solution tank level monitor 23 that fuel-cleaner solution in solution tank 11 in FIG. 1 has reached the pre-selected level called reserve level microcomputer 20 in FIG. 2 will send a first unique set of frequencies to audio alarm 26. At this time the operator should shut down work piece engine. If engine is not shut down and run time 57 in FIG. 3 timer reaches zero or solution tank level monitor 23 in FIG. 2 detects that solution level is at empty level microcomputer 20 will send a second unique set of frequencies to be sounded by audio alarm 26. At this time microcomputer 20 will also send a signal to engine cut-off solenoid driver 28 which will cause work piece engine fuel system to stop fuel flow to engine thus causing engine to shut down.

After work piece engine has been shut down the operator presses stop key on keypad 21 in FIG. 2. LCD display 22 will display STOP. The operator now disconnects the apparatus from engine.

SUMMARY

The electronically controlled carbon-cleaning system for internal combustion engines described above comprises a microcomputer and firmware containing a program. The stored instructions in the program control the electro-mechanical components of the cleaning apparatus. The microcomputer and associated electronics perform all control, and user interface functions. All electrical current flow is controlled via solid state switches. All physical measurements are performed by electronic sensors.

The microcomputer provides the apparatus with the abilities and the advantages of

- performing self test and verification of proper input voltage at power up;
- continuously monitoring the input voltage;
- performing calculations and adjustments to operate on any Direct Current input voltage;
- measuring, displaying and monitoring fuel level in the solvent tank;
- shutting the electric motor and thus the pump off when the solvent tank is full;
- shutting the electric motor and thus the pump off when the solvent tank becomes empty;
- executing procedures received from the keypad;
- monitoring the system pressure and adjusting the pump to maintain set pressure/flow rate;
- controlling engine cutoff solenoid relay;
- providing program mode and machine status to the operator
- controlling the audio alarm The invention presented here also provides the advantage of reduced heat in the electric motor by applying only the voltage necessary to operate the pump at the desired set pressure and by physically separating the electric motor and pump. The reduction of heat in the electric motor and the pump provides increased reliability of the electric motor and the pump.

This invention provides a solution to all of the problems described in the prior art.

ALTERNATE FORMS AND SCOPE

Although the description above contains many specificities, these should not be construed as limiting the scope of the invention but merely providing illustrations of some of the presently preferred embodiments of this invention. For example any computer may be used for the control of the apparatus. An all electronic hardware approach could also be utilized. The instructions or the program may be stored on any media. Examples of this would be compact disk, floppy disk, hard disk or any other type of device used to store digital data. The display may utilize any display technology. Examples of common display technologies are Cathode Ray Tube, Liquid Crystal Display, Light Emitting Diode, Gas Discharge, Electro-luminescent or any other device or technology used to display alphanumeric characters or graphics. The keypad may be composed of any form of switch or other motion or proximity sensing device.

The electric motor can be any type of rotating device which can be used as a driving force to rotate the pump. The velocity reduction mechanism can be gear, chain, or belt driven. The pump can be any diaphragm, gear, centrifugal, piston, or any other type.

Another form of fuel pressurization or feed could be to pressurize the solvent tank with compressed gas. This gas could be air, nitrogen, carbon dioxide or any other type of compressed gas. The pressure of the compressed gas could be controlled or the pressure of the cleaning solution could be controlled by the microcomputer.

Thus the scope of the invention should be determined by the appended claims and their legal equivalent, rather than by the examples given.

Having thus described my invention I claim:

1. An electronically controlled carbon-cleaning system for internal combustion engines, comprising

- a pump for siphoning fuel from a container and for pumping fuel and cleaning solution to an internal combustion engine and through a filter,
- a motor coupled to said pump for driving said pump at various pumping speeds,
- a solution tank for holding fuel and cleaning solution,
- a solution tank level monitor in communication with said solution tank for monitoring the level of fluid in said solution tank,
- a feed tube in communication with said solution tank and coupled to said pump via a transfer hose for providing fluid to and from said solution tank,
- a supply/fill hose coupled to said pump for siphoning fuel from the container into said solution tank and for supplying fuel and cleaning solution to said internal combustion engine,
- an inlet tube in communication with said solution tank,
- a return hose coupled to said inlet tube for returning fuel and cleaning solution from said internal combustion engine to said solution tank,
- a power cable connectable to a power source and adaptable for supplying power to said engine cleaning system,
- an electronic control system for controlling the operation of said engine cleaning system comprising a processor for controlling the operation of said electronic control system,
- said solution tank level monitor electrically coupled to said processor via a tank level monitor signal wire for sending a tank level monitor signal to said processor indicating that a predetermined level of fluid has been reached in said solution tank, and
- a solid state motor control electrically coupled between said processor and said motor for the processor-controlled removal of power from said motor when said predetermined level of fluid has been reached in said solution tank, thereby causing said pump to stop pumping.

2. The engine cleaning system of claim 1 wherein said filter is coupled between said pump via a filter/pump interconnecting hose and said supply/fill hose for filtering particles from the fuel and cleaning solution being provided to said internal combustion engine.

3. The engine cleaning system of claim 1 wherein said filter is coupled between said inlet tube and said return hose for filtering particles from the fuel and cleaning solution being provided to said internal combustion engine.

4. The engine cleaning system of claim 1 wherein said power cable is coupled to a reverse polarity protection circuit for assuring the proper application of power source polarity.

5. The engine cleaning system of claim 1 wherein said electronic control system further comprises a self-test circuit for self-testing and informing a user of a malfunction prior to connection of said engine cleaning system to said internal combustion engine.

6. The engine cleaning system of claim 1 wherein said power cable is coupled to a voltage regulator, said voltage regulator for automatically shutting off power to said engine cleaning system when supplied voltage is out of the range of acceptable system operating voltages.

7. An electronically controlled carbon-cleaning system for internal combustion engines, comprising a pump for siphoning fuel from a container and for pumping fuel and cleaning solution to an internal combustion engine and through a filter, a motor coupled to said pump for driving said pump at various pumping speeds, a solution tank for holding fuel and cleaning solution, a solution tank level monitor in communication with said solution tank for monitoring the level of fluid in said solution tank, a feed tube in communication with said solution tank and coupled to said pump via a transfer hose for providing fluid to and from said solution tank, a supply/fill hose coupled to said pump for siphoning fuel from the container into said solution tank and for supplying fuel and cleaning solution to said internal combustion engine, an inlet tube in communication with said solution tank, a return hose coupled to said inlet tube for returning fuel and cleaning solution from said internal combustion engine to said solution tank, a power cable connectable to a power source and adaptable for supplying power to said engine cleaning system, an electronic control system for controlling the operation of said engine cleaning system comprising a processor for controlling the operation of said electronic control system and for storing a desired system pressure set point, said electronic control system further comprising a keypad and a display screen for selecting said desired system pressure set point, a pressure transducer in communication with said supply/fill hose for monitoring a fluid pressure in said supply/fill hose and for sending a pressure signal indicative of said fluid pressure to said processor, and a solid state motor control coupled between said processor and said motor for the processor-controlled modification of the power being supplied to said motor for modifying the pumping speed of said pump in a manner which will modify said supply/fill hose fluid pressure in said engine cleaning system to conform with said desired system pressure set point.

8. An electronically controlled carbon-cleaning system for internal combustion engines, comprising a pump for siphoning fuel from a container and for pumping fuel and cleaning solution to an internal combustion engine and through a filter, a motor coupled to said pump for driving said pump at various pumping speeds, a solution tank for holding fuel and cleaning solution, a solution tank level monitor in communication with said solution tank for monitoring the level of fluid in said solution tank, a feed tube in communication with said solution tank and coupled to said pump via a transfer hose for providing fluid to and from said solution tank, a supply/fill hose coupled to said pump for siphoning fuel from the container into said solution tank and for supplying fuel and cleaning solution to said internal combustion engine, an inlet tube in communication with said solution tank, a return hose coupled to said inlet tube for returning fuel and cleaning solution from said internal combustion engine to said solution tank, a power cable connectable to a power source and adaptable for supplying power to said engine cleaning system, an electronic control system for controlling the operation of said engine cleaning system comprising a processor for controlling the operation of said electronic control system and for storing a predetermined condition, said electronic control system further comprising a keypad and a display screen for selecting said predetermined condition, said solution tank level monitor electrically coupled to said processor via a tank level monitor signal wire for sending a tank level monitor signal to said processor indicating that a predetermined level of fluid has been reached in said solution tank, and an engine cutoff solenoid driver coupled between said processor and an internal combustion engine's cutoff solenoid for turning off said internal combustion engine when said predetermined condition is satisfied.

9. The engine cleaning system of claim 8 wherein said predetermined condition is when the fluid level of said solution tank reaches a predetermined reserve level.

10. The engine cleaning system of claim 9 wherein a first distinguishable audible alarm signals the satisfaction of said predetermined condition.

11. The engine cleaning system of claim 8 wherein said predetermined condition is when the fluid level of said solution tank reaches empty.

12. The engine cleaning system of claim 11 wherein a second distinguishable audible alarm signals the satisfaction of said predetermined condition.

13. The engine cleaning system of claim 8 further comprising a timer for selecting the duration of the engine cleaning process coupled to said electronic control system wherein said predetermined condition is when the time remaining on said timer reaches a predetermined amount of time.

14. The engine cleaning system of claim 8 further comprising a timer for selecting the duration of the engine cleaning process coupled to said electronic control system wherein said predetermined condition is when the time remaining on said timer reaches zero.

15. An electronically controlled carbon-cleaning system for internal combustion engines, comprising a motor for driving a pump at various pumping speeds, a solution tank for holding fuel and cleaning fluids, said pump capable of being in fluid communication with said solution tank and an internal combustion engine, an electronic control system comprising a processor for controlling said motor and said pump, a pressure transducer in communication with a supply/fill hose for monitoring a fluid pressure in said supply/fill hose and for sending a pressure signal indicative of said fluid pressure to said processor, said electronic control system further comprising a keypad and a display screen for selecting a desired system pressure set point, and a solid state motor control coupled between said processor and said motor for the processor-controlled modification of power being supplied to said motor for modifying the pumping speed of said pump in a manner which will modify said supply/-fill hose fluid pressure in said engine cleaning system to conform with said desired system pressure set point.

* * * * *